United States Patent [19]

Hannershg

[11] Patent Number: 4,958,646

[45] Date of Patent: Sep. 25, 1990

[54] METHOD FOR DRAPING CURTAINS

[75] Inventor: Christer Hannershg, Hollviksnas, Sweden

[73] Assignee: AB A.Svensson & Co., Malmö, Sweden

[21] Appl. No.: 370,340

[22] Filed: Jun. 22, 1989

Related U.S. Application Data

[63] Continuation-in-part of Ser. No. 114,655, Oct. 28, 1987, abandoned.

[30] Foreign Application Priority Data

Oct. 29, 1986 [DE] Fed. Rep. of Germany ..... 3636845
Oct. 12, 1987 [EP] European Pat. Off. ..... 265759

[51] Int. Cl.[5] ..... A47H 13/14
[52] U.S. Cl. ..... 160/348; 160/349.2
[58] Field of Search ..... 160/348, 349.1, 349.2, 160/405; 248/251, 252, 261, 262; D6/578, 580; D8/354, 368, 369, 370, 371

[56] References Cited

U.S. PATENT DOCUMENTS

| | | | |
|---|---|---|---|
| D. 120,628 | 5/1940 | Jembrzycki . | |
| 247,860 | 10/1881 | Warner . | |
| D. 286,261 | 10/1986 | Smederöd . | |
| 361,007 | 4/1887 | Gould . | |
| 464,499 | 12/1891 | Grenelle . | |
| 744,691 | 11/1903 | Porter . | |
| 827,000 | 7/1906 | Dinsmore . | |
| 851,678 | 4/1907 | Levy . | |
| 1,530,180 | 3/1925 | Holmes . | |
| 1,730,979 | 8/1929 | Liebchen . | |
| 1,817,962 | 8/1931 | Breuer . | |
| 1,836,018 | 12/1931 | Dover . | |
| 1,874,813 | 8/1932 | Saunders . | |
| 1,980,918 | 11/1934 | Hudspeth | 160/349.2 X |
| 2,244,129 | 6/1941 | Stratton . | |
| 2,431,934 | 12/1947 | Higgins | 160/349 |
| 2,480,360 | 8/1949 | Doty | 248/252 |
| 2,588,246 | 3/1952 | Kenney . | |
| 2,606,733 | 8/1952 | Krajewski | 160/348 X |
| 2,607,412 | 8/1949 | Vance et al. | 160/348 |
| 2,637,384 | 5/1953 | McCabe . | |
| 2,909,354 | 10/1959 | Bingham . | |
| 3,104,086 | 9/1963 | Salzmann . | |
| 3,203,469 | 8/1965 | Falkenberg | 160/348 |
| 3,317,167 | 5/1967 | Becker et al. . | |
| 3,417,807 | 3/1966 | Falkenberg | 160/348 |
| 3,545,523 | 12/1970 | Falkenberg | 160/348 |
| 3,901,303 | 8/1975 | Falkenberg | 160/348 |
| 4,284,258 | 8/1981 | Kleiman | 248/251 |

FOREIGN PATENT DOCUMENTS

| | | |
|---|---|---|
| 449312 | 9/1927 | Fed. Rep. of Germany . |
| 449312 | 9/1927 | Fed. Rep. of Germany . |
| 1215456 | 4/1960 | France . |
| 20736 | 10/1905 | United Kingdom . |
| 785300 | 10/1957 | United Kingdom . |
| 1278118 | 6/1972 | United Kingdom . |

*Primary Examiner*—David M. Purol

[57] ABSTRACT

A method for draping curtains comprising the steps of attaching holders to an upright wall, plaiting a curtain material into a bar-like bundle, and placing the curtain material over the legs of the holder in such a way that the curtain material is retained while a draping arc is formed.

4 Claims, 6 Drawing Sheets

METHOD FOR DRAPING CURTAINS

This is a continuation of copending application Ser. No. 07/114,655 filed on Oct. 28, 1987.

BACKGROUND OF THE INVENTION

The present invention is directed to an assembly for draping curtains or the like.

When draping a window curtain or a portiere, the curtain material is plaited or folded to form a bar-like bundle (zigzag or meander plaiting) and is placed over two supporting rods which are mounted in horizontally spaced relationship above the window or door. To form a draping arc between the two supporting rods, the lower portion of the curtain material is thereafter pulled down to form circular-segment-type folds. It is extremely difficult and requires a corresponding degree of skill to keep the upper-most fold or folds taut between the two supporting rods.

It is the object of the present invention to modify the above-mentioned supporting rods in such a way that during the forming of a draping arc the uppermost folds are always kept taut in an operation that does not require any special skill.

SUMMARY OF THE INVENTION

The above-specified object is solved in a surprisingly simple way by using the holders described below.

When the holders of the present invention are used, it is extremely simple even for an unskilled person to form a draping arc between two horizontally spaced holders. There is no risk of the uppermost folds being pulled down while the draping arc is formed so that the curtain would actually "sag" between the two holders. Also, the operation does not require two or more persons, which is normally the case when draping a curtain or the like in accordance with the conventional technique, particularly when larger draping arcs or greater distances between the curtain holders are concerned.

It is preferred that the holder in accordance with the present invention is made from a flat bar section, and in one embodiment from flat iron bent to U-shape, wherein the upper leg when in the mounted state is shorter than the lower leg through which the holder can be secured to an upright wall or the like. This embodiment is a particularly simple design which can be manufactured with corresponding economy.

When it is desired to provide two or more draping arcs between two outermost holders according to the present invention, one or more intermediate hook-like holders are provided which can respectively be secured to an upright wall in spaced relationship therefrom. Finally, another embodiment of a draping holder permits the formation of fabric rosettes at the supporting or holding locations of the curtain or curtain material. These holders are in fact ornamental holders.

BRIEF DESCRIPTION OF THE DRAWINGS

Below, a preferred embodiment of the assembly according to the invention will be explained in detail with reference to the accompanying drawing, in which like reference numbers refer to like members throughout the various figures.

DESCRIPTION OF THE PREFERRED EMBODIMENTS

Figure 1:
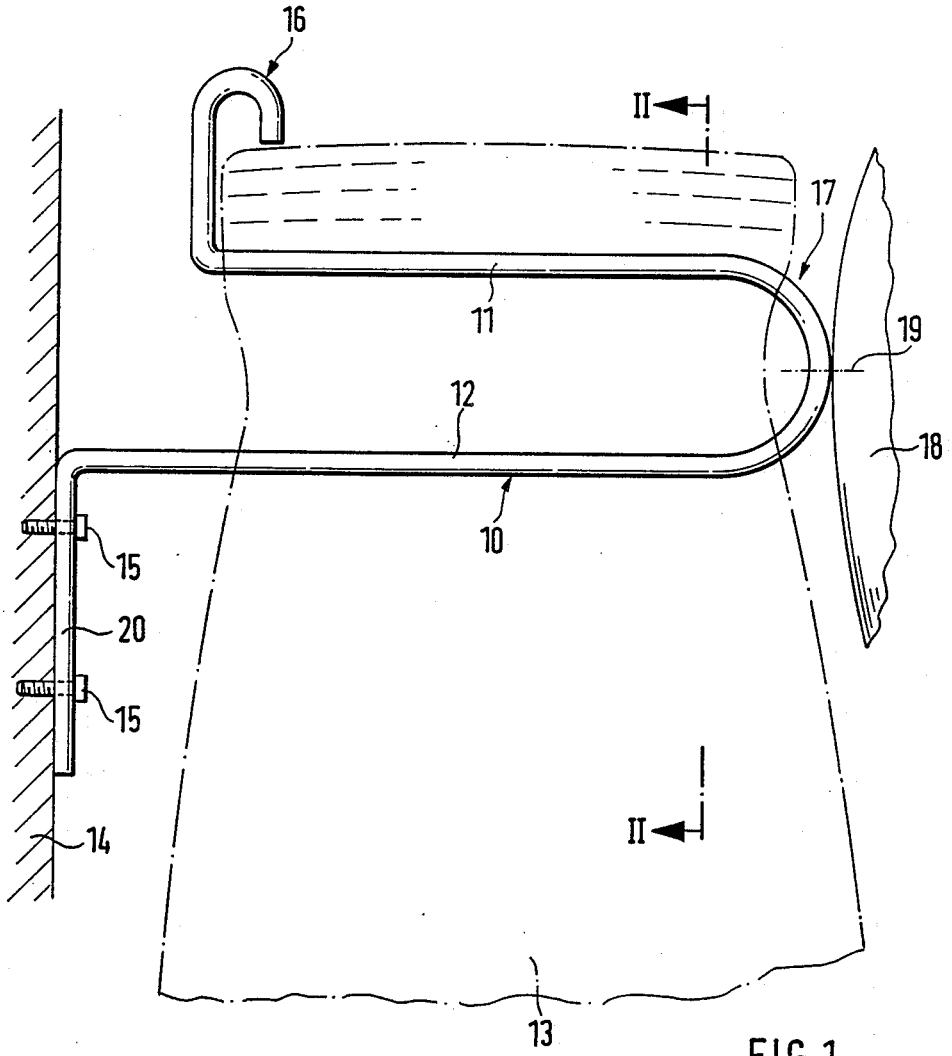
FIG. 1 is a side view of a draping holder of the present invention.
Figure 2:
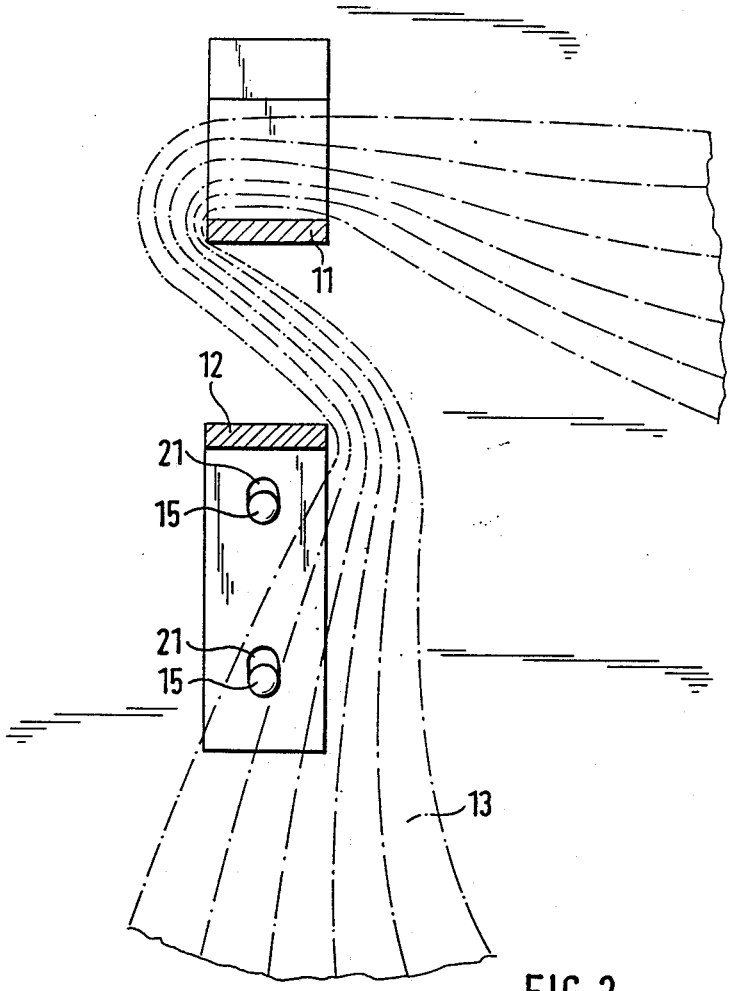
FIG. 2 is a section along the line II—II of FIG. 1 showing the draping holder of FIG. 1.

The assembly according to the present invention for draping curtains or the like features at least one especially two horizontally spaced holder 10 bent to U-shape over whose respective legs 11, which in the mounted state form the upper legs. A curtain material 13 folded to form a bar-like bundle is placed and is subsequently passed from the outside to the inside between the upper and the lower legs of the mentioned holders such that the curtain material is retained on the holders 10 while the desired draping is maintained. In FIGS. 1 and 2, the lower leg of the holder 10 of the present invention is referenced 12.

The U-shaped holder 10 is bent from a flat bar section, i.e., coated flat iron, and the upper leg 11 in the mounted state is somewhat shorter than the lower leg 12 through which the holder 10 may be secured to an upright wall 14 (fastening screws 15).

At its free end, i.e., the end presented to the wall 14, the upper leg 11 when in the mounted state is initially bent upwards and subsequently bent forwardly downwards to form an open-bottomed C- or U-shaped terminal portion 16 which actually fixes the curtain material placed over the upper leg 11 (see FIG. 1).

The inward terminal portion 16 of the upper leg 11 has a dual function as lateral and upper limiting means with a gripping effect on the curtain material placed over the upper leg 11; of course, this is true under the condition that the curtain material draped to form a bar-like bundle has a height in excess of the distance between the lower end of the terminal portion 16 and the top of the upper leg 11. In order to ensure this feature, said distance is preferably about 5 to 10 mm, especially about 6 to 7 mm.

In the vicinity of the U-bend 17 of the holder 10 there is likewise provided an outer limiting means for the curtain material 13 placed over the upper leg 11. This limiting means projects beyond the top of the upper leg 11 and is configured as a rosette 18 which overlaps the U-bend 17 of the holder 10 both upwardly and downwardly. The rosette 18 is secured in the vicinity of the U-bend 17 of the holder 10 by means of a screw 19 which is indicated in FIG. 1. Instead thereof, a rivet joint, an adhesive joint or a solder joint would also be conceivable.

The free end of the lower leg 12 of the U-shaped holder 10 is bent downward to form a lug-like connecting member 20 through which the holder 10 can be mounted on the wall 14 by means of fastening screws 15 which are disposed above one another in spaced relationship. To this end the connecting member 20 is formed with through-holes 21 (see FIG. 2). As illustrated in FIG. 2, the holes 21 are elongated holes so that during assembly the holders 10 can be slightly shifted up and down for elevational adjustment with a similar holder mounted in horizontally spaced relationship.

A further intermediate leg, which is not illustrated in the present embodiment, may also be provided between the upper leg 11 and the lower leg 12. Such intermediate leg extends approximately in parallel with the upper and the lower legs, so that the curtain material 13 which is draped to form a bar-like bundle can be passed between upper leg 11 and intermediate leg, and then passed between the intermediate leg and lower leg 12.

It should be noted that the upper leg 11 is shorter than the lower leg 12 of the holder 10 to facilitate the introduction of the curtain material, which has been draped to a bar or board-like bundle, into the region between upper and lower leg through the gap between the upright wall 14 or the like and the free inner end of the upper leg 11. The draped curtain material 13 is actually "threaded" through said gap into the region between the upper and lower leg of the holder 10. This "threading" is additionally facilitated by the described configuration of the wall-side terminal portion 16 of the upper leg 11. There is no risk of the "threaded" curtain material 13 being caught. The upper leg 11 is shorter than the lower leg 12 by an amount which preferably corresponds approximately to the inside spacing between upper and lower leg.

It is especially advantageous when the upper leg is slightly inclined in the direction towards its free end relative to the lower leg 12, the angle of inclination relative to the lower leg 12 being about 5 to 10 degrees. Thereby the retaining or clamping action between draped curtain material 13 and holder 10 is improved.

It should be noted that in FIGS. 1 and 2 the draped curtain material 13 is indicated in dashed lines for the sake of clarity.

Figure 4:
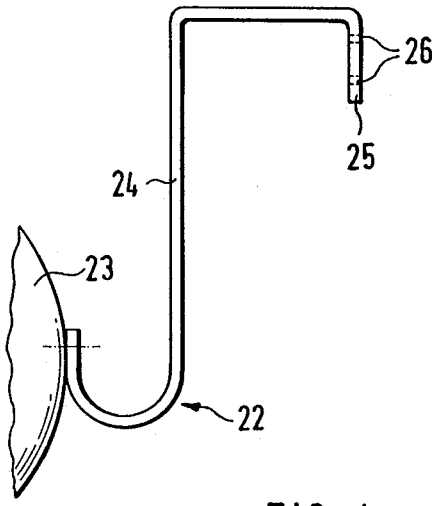
FIG. 4 is a side view of an intermediate hook drawn to reduced scale.

For the provision of two or more draping arcs between two outermost holders 10 of the described kind, one or several intermediate holders configured like a hook 22 are provided (see FIGS. 3 and 4), said hook being mounted in spaced relationship from an upright wall or the like.

Actually, the intermediate hook 22 is likewise bent from a flat bar section, preferably coated flat iron. The free end of the hook is covered by a front rosette 23 which is similar to the rosette 18 of the hook 10. For mounting the hook 22 in spaced relationship from the upright wall, the wall-side leg 24 of the hook 22 is twice bent by 90 degrees to form a connecting member 25 parallel with the wall, said connecting member being formed with at least two holes 26 above one another for the passage of fastening screws or means to attach the connecting member to the wall.

Figure 3:
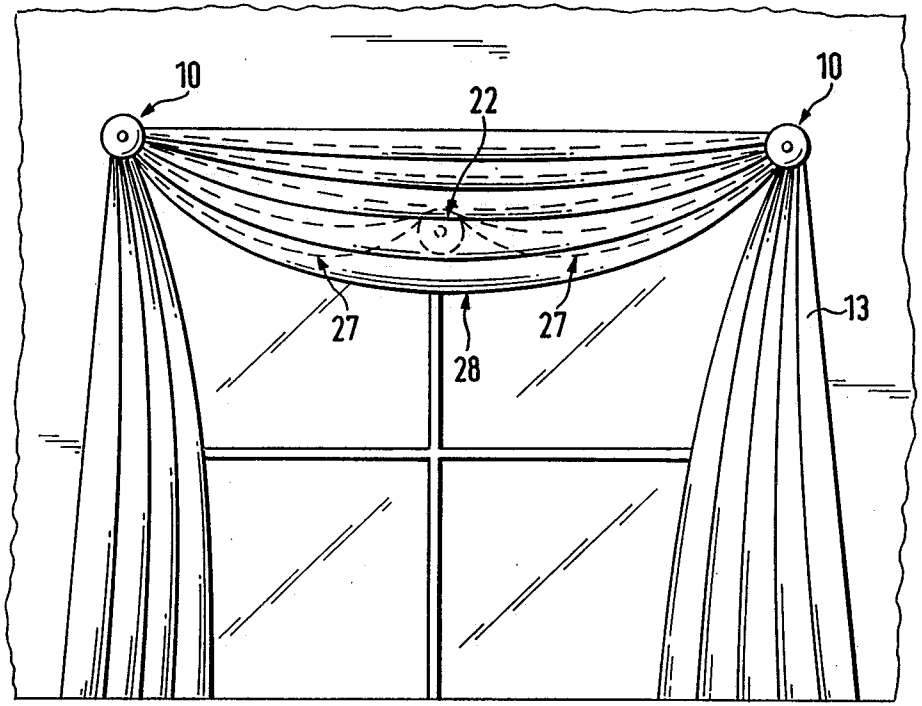
FIG. 3 is the assembly of the draping holders according to the present invention above a window, illustrating a draping arc formed between these two holders and showing (in dashed lines) an intermediate hook disposed between the two outer draping holders for providing two draping arcs.

FIG. 3 indicates in dashed lines a possible position of the intermediate hook 22 relative to the two outermost holders 10 to form two draping arcs 27. When the intermediate hook 22 is omitted, only a single draping arc 28 can be formed between the two outermost holders 10.

The intermediate hook 22 may also be configured as a loose U-bracket which is open-topped in the mounted state, the forward leg again being covered by a rosette 23 serving as a screen element.

With the described holders it is extremely easy for anyone to drape curtains by forming horizontal draping arcs and draped shawls which respectively depend from the holders 10 according to the present invention for framing the sides of a window or a door.

Figure 7:
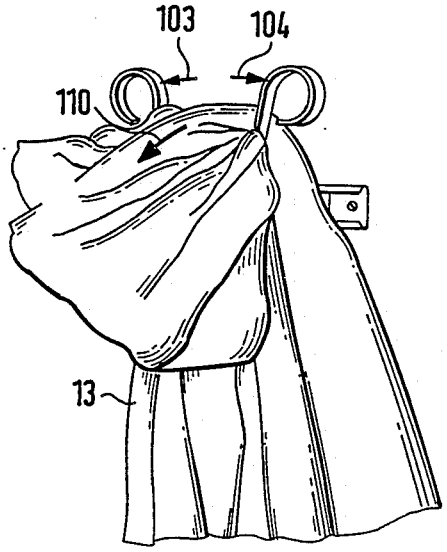
Figure 8:
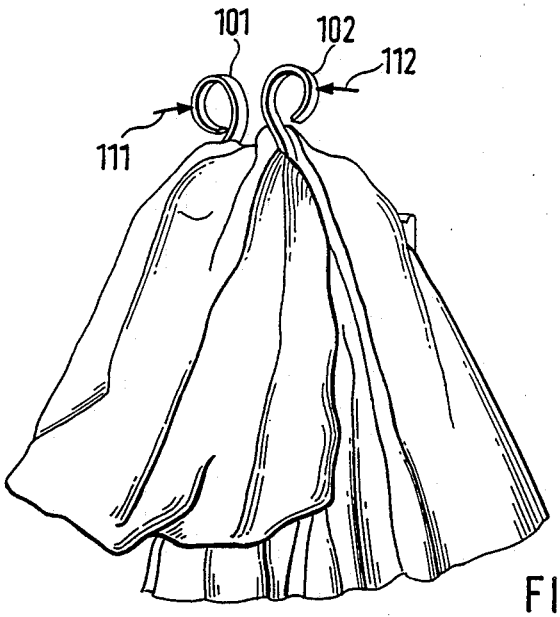
Figure 9:
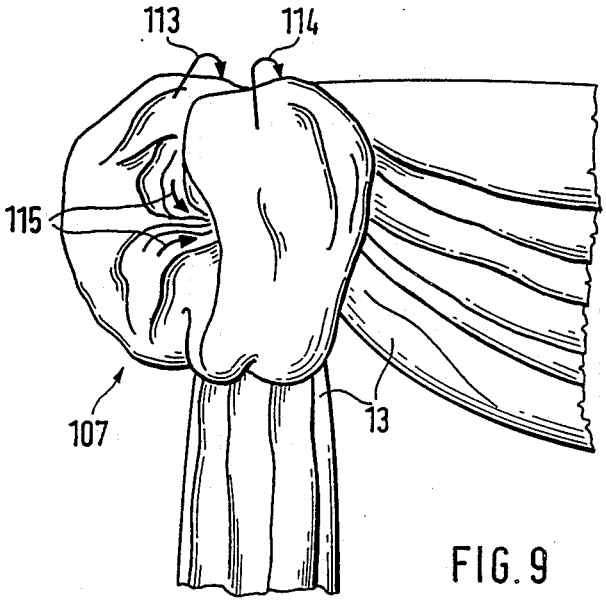
Figure 10:
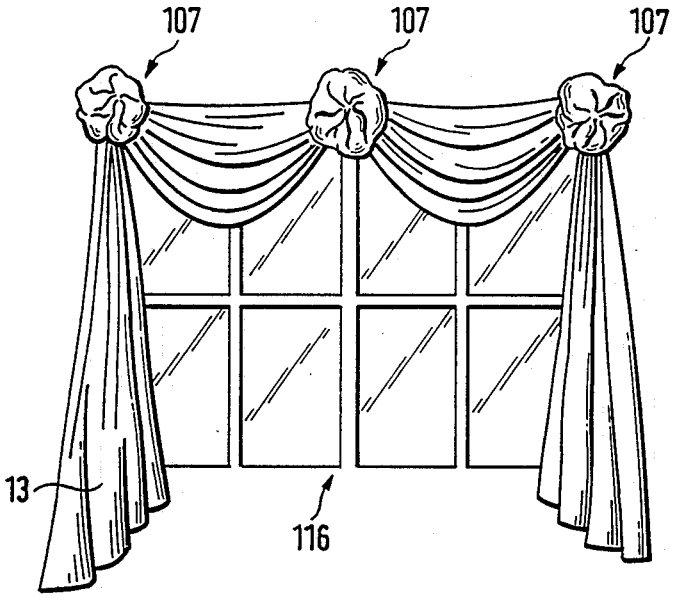
FIG. 10 shows a fully draped window curtain making use of three horizontally spaced draping hooks shown in FIG. 5 and mounted above the window.

FIGS. 5 to 10 illustrate a further embodiment of a draping holder 100 and the use thereof, whereby fabric rosettes 107 are formed in the vicinity of the holder and simultaneously cover the same (see FIGS. 9 and 10). Thus, the holder 100 is in fact a kind of ornamental hook.

Figure 6:
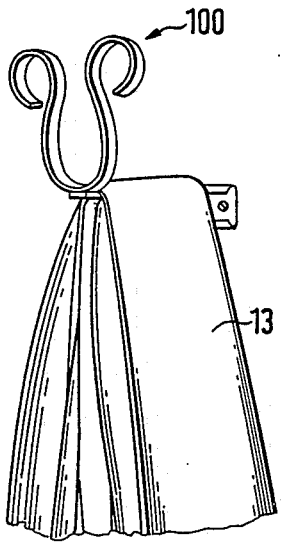
FIGS. 6–9 are perspective views respectively illustrating the draping of a curtain by using a holder as shown in FIG. 5.

The holder 100 is made from metallic flat bar material or the like and bent to approximate C-shape. It is mounted in spaced relationship from a wall 14 via an L-bracket 105 secured to the wall (mounting plate 108 and fastening screws 109 in FIG. 5) such that the plane defined by the two prongs 101, 102 of the holder extends approximately in parallel with the wall 14 or the surface thereof, respectively. To provide the mentioned rosettes 107, the curtain material 13 is initially placed over the L-bracket 105 in meander-pleated configuration as illustrated in FIG. 6. Then an upper layer of curtain material is pulled forwards through the two prongs 101 and 102 as shown in FIG. 7 (see arrow 110 in FIG. 7), and during this operation the two prongs 101, 102 are resiliently spread apart (see arrows 103, 104 in FIG. 7). The curtain material is pulled forward between the two prongs 101 and 102 approximately as far as shown in FIG. 8. When this step has been completed the two prongs 101 and 102 will return to their initial positions as indicated by the arrows 111, 112.

Thereafter, the forwardly pulled portion of the curtain material 13 is turned back over and between the prongs 101, 102 (see arrows 113, 114, 115 in FIG. 9) to obtain the desired rosette 107.

Figure 5:
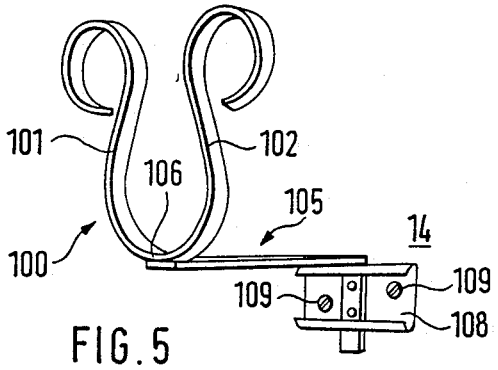
FIG. 5 is a perspective view showing a further embodiment of a draping holder according to the present invention.

FIG. 10 illustrates a curtain 13 fully draped around a window 116, wherein draping has been performed by the use of three horizontally spaced draping holders 100 shown in FIG. 5 and mounted above the window 116.

All of the features disclosed in the present documents are claimed as being essential to the invention to the extent to which they are novel over the prior art either individually or in combination.

What is claimed is:

1. A method for draping curtains comprising the steps of:

(a) attaching two holders to an upright wall, each holder having a C-shaped member positioned between and joining two prongs terminating in a curved surface portion at an upper end thereof, the C-shaped member being affixed to a bar member at an end of the C-shaped member opposite its opening, said bar member having means to attach the holder to a wall;

(b) placing a lengthwise folded curtain forming material defining a plurality of layers thereof over each bar member;

(c) pulling an upper layer of said lengthwise folded curtain forming material forwardly through the prongs of each holder; and (d) pulling said upper layer of said curtain forming material rearwardly and upwardly over said curved surface portions of each holder to form two fabric rosettes and a draping arc between the fabric rosettes.

2. The method for draping curtains according to claim 11 further comprising the steps of attaching a third holder to a wall between the two holders in spaced relation therefrom, and placing the curtain material over the holders in such a way as to form three fabric rosettes and two draping arcs between the fabric rosettes.

3. A method for draping curtains comprising the following steps:

attaching two holders to an upright wall, each holder including a bar member having a first end and a second end, a first prong and a second prong projecting upwardly from adjacent said first end of said bar member and forming a space between said first and second prongs and means for attaching the bar member to a wall being provided adjacent to said second end of said bar member;

placing a lengthwise folded curtain forming material defining a plurality of layers thereof over each bar member;

pulling an upper layer of said lengthwise folded curtain forming material forwardly through the space formed between said first and second prongs of each holder; and pulling said upper layer of said curtain forming material rearwardly and upwardly over said first and second prongs to form two fabric rosettes.

4. The method for draping curtains according to claim 3, further comprising the steps of attaching a third holder to a wall between the two holders in spaced relation therefrom, and placing the curtain material over the holders in such a way as to form three fabric rosettes and two draping arcs between the fabric rosettes.

* * * * *

UNITED STATES PATENT AND TRADEMARK OFFICE

CERTIFICATE OF CORRECTION

PATENT NO. : 4,958,646

DATED : September 25, 1990

INVENTOR(S) : Christer Hannerstig

It is certified that error appears in the above-identified patent and that said Letters Patent is hereby corrected as shown below:

On the title page, under (75) Inventor:
change "Christer Hannershg" to

-- Christer Hannerstig --

Under (63), change "Continuation-in-part of Ser. No. 114,655, October 28, 1987, abandoned." to -- Continuation of Ser. No. 114,655, October 28, 1987, abandoned. --

Column 4, line 65:

Claim 2, line 2, change "11" to -- 1 --

Signed and Sealed this

Seventh Day of January, 1992

*Attest:*

HARRY F. MANBECK, JR.

*Attesting Officer*

*Commissioner of Patents and Trademarks*